US008580724B2

(12) United States Patent
McCormick et al.

(10) Patent No.: US 8,580,724 B2
(45) Date of Patent: Nov. 12, 2013

(54) METAL LOSS INHIBITOR FORMULATIONS AND PROCESSES

(75) Inventors: David R. McCormick, Clawson, MI (US); Ronald F. Dubs, Oxford, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/316,640

(22) Filed: Dec. 12, 2011

(65) Prior Publication Data

US 2012/0122749 A1 May 17, 2012

Related U.S. Application Data

(63) Continuation of application No. PCT/US2010/039785, filed on Jun. 24, 2010.

(60) Provisional application No. 61/220,331, filed on Jun. 25, 2009.

(51) Int. Cl.

| | |
|---|---|
| ***C11D 1/72*** | (2006.01) |
| ***C11D 3/26*** | (2006.01) |
| ***C11D 3/30*** | (2006.01) |

(52) U.S. Cl.

USPC ..... 510/245; 510/255; 510/259; 510/263; 510/421; 510/433; 510/492; 510/499; 510/504; 510/505; 510/506; 134/41

(58) Field of Classification Search

USPC ..... 510/245, 255, 259, 263, 421, 433, 492, 510/499, 504, 505, 506; 134/41

See application file for complete search history.

(56) References Cited

U.S. PATENT DOCUMENTS

| | | | | |
|---|---|---|---|---|
| 4,541,945 | A | 9/1985 | Anderson et al. | |
| 6,344,090 | B1 | 2/2002 | Johnston | |
| 6,521,028 | B1 | 2/2003 | Frenier | |
| 6,540,943 | B1 | 4/2003 | Treybig et al. | |
| 2005/0256021 | A1* | 11/2005 | Lu et al. | 510/407 |
| 2007/0164258 | A1 | 7/2007 | Emerson et al. | |

* cited by examiner

*Primary Examiner* — Gregory Delcotto
(74) *Attorney, Agent, or Firm* — Mary K. Cameron

(57) ABSTRACT

In one embodiment, a metal loss inhibitor concentrate is provided which contains water, (A) a component of dissolved organic compounds and polymers that contain at least two hydroxy moieties per molecule and an average of at least 0.4 hydroxy moieties per carbon atom; (B) a thiourea component; and (C) a dissolved component containing aryl and quaternary ammonium moieties; and, optionally: (D) a wetting agent, such as a component of an ethoxylate of an alcohol. Such solutions form useful inhibitor concentrates when combined with aqueous chelating cleaning solutions, wherein such solutions, when contacted with a metal surface, are effective in removing scale, smut and other deposits from the metal surface but exhibit a reduced tendency to attack or unduly etch the metal itself, or to inhibit the subsequent desired oxidation and dissolution of metallic copper deposits.

23 Claims, No Drawings

METAL LOSS INHIBITOR FORMULATIONS AND PROCESSES

CROSS-REFERENCE TO RELATED APPLICATIONS

This application is a continuation under 35 U.S.C. Section 365(c) and 120 of International Application No. PCT/US2010/039785, filed Jun. 24, 2010 and published on Dec. 29, 2010 as WO 2010/151641, which claims priority from U.S. Provisional Patent Application No. 61/220,331 filed Jun. 25, 2009, which are incorporated herein by reference in their entirety.

FIELD OF THE INVENTION

This invention relates to metal loss inhibitor concentrates and solutions prepared therefrom which are useful for the pickling and/or cleaning of metal surfaces. More particularly, the metal loss inhibitors are used in chelating type cleaners, typically containing organic acids and/or organic acid salts at mid- to high-pH.

BACKGROUND OF THE INVENTION

Vessels, pipes, condensers and boilers used in the chemical & food processing industries, power plants, oil field operations are subject to the formation of scale, which interferes with functioning. The word "scale" when used herein includes any solid deposit formed on a solid metal surface, such as ferriferous metal surfaces, as a result of contact between the metal surface and an aqueous solution in liquid or vapor state. During use, water storage tanks, conduits, plumbing, cooling towers, process equipment, electrolysis membranes and other units develop scale which must be removed, preferably dissolved in order to maintain flow, thermal conductivity, to avoid under-deposit corrosion and hot spots that can cause boiler tube failures and to maintain the highest possible energy efficiency.

Historically, this scale was removed using a solution of hydrochloric acid. To accelerate the cleaning process, the aqueous HCl cleaner was often heated to as high as 100 degree C., but cleaning still took 4 to 12 hours or more to accomplish. The hydrochloric acid is usually present in such cleaners in a concentration range of from 2.5-15% by weight, which, upon repeated use, can be quite damaging to the metal parts of the aforementioned units.

The HCl cleaners alone often did not adequately remove silica or copper, which typically required additional additives or processes. Metallic copper deposits were generally removed by a separate step using ammoniated sodium bromate solution. Both steps resulted in higher chemical and waste disposal costs. The sodium bromate stage required a separate chemical fill and an extra rinse step. Another drawback of HCl cleaners is the high concentration of chloride ion in the cleaning solution. Chloride ion concentrations above 100 ppm or so are typically not acceptable for use in nuclear plants and certain other infrastructure due to concerns regarding possible, and difficult to predict, chloride stress corrosion damage.

It is known to utilize certain compounds or mixtures of compounds in conventional acidic HCl-based solutions that are utilized for cleaning or pickling metal surfaces to remove therefrom unwanted oxides, scale and other undesirable corrosion products. Such compounds reduce the tendency of the acidic cleaning solution to dissolve the metal surface without interfering with the cleaning operation performed by the solution. Compounds that function in this manner are generally referred to as "acid inhibitors". In the absence of acid inhibitors, an acidic metal cleaning or pickling solution can cause significant base metal loss and also damage that can extend below the metal surface as a result of excessive hydrogen exposure which occurs in the absence of acid inhibitors.

Newer methods of cleaning or pickling metal surfaces to remove therefrom unwanted oxides, scale and other undesirable corrosion products seek to eliminate strongly acid cleaners based on HCl and instead use organic acids and/or organic acid salts at mid- to high-pH to accomplish the cleaning. An important benefit of these cleaners, referred to hereinafter as "chelating cleaners" is elimination of separate chemistries for removal of metallic copper. Metallic copper and some copper containing deposits are removed with the cleaning solution in a lower temperature second step; after lowering the temperature to about 150 degree F. and dissolving a solid, and/or while injecting a gaseous oxidizing agent. Other benefits of these cleaners include chloride-free compositions, less acidic pH, and easier waste management. Steel surfaces are left in a clean and passivated state.

The chelating cleaning solution is effective in removing undesirable deposits from metal surfaces, including those that contain silica and copper, and even metallic copper itself when using ammonia and oxidizer, but unfortunately it also tends to attack and corrode the base metal, particularly cold rolled steel. Such corrosion is very undesirable. To counteract the corrosive effects of the chelating cleaning solution, it is desirable to provide "metal loss inhibitors" for addition to the chelating cleaning solution.

It is likewise desirable to provide a metal loss inhibitor that readily disperses irreversibly throughout chelating cleaning solutions, suppresses etch and corrosion of the base metal with which it comes into contact, does not interfere with silica or copper removal, suppresses hydrogen formation and its damage and leaves little or no smut or residual film on the surface of the metal. It must also maintain effectiveness over a range of pH and iron concentrations and temperatures, with such effectiveness being sufficiently long lasting so that the metal pickling or cleaning solution need not be frequently discarded or replenished.

Further, it is desirable for cost and convenience reasons to market such metal loss inhibitor compositions in the form of concentrates that are diluted and combined with aqueous chelating cleaning solutions to prepare a metal pickling or cleaning solution. Alternatively, such concentrates are diluted to working concentrations with water and then various additional components are mixed in to prepare the working metal pickling or cleaning solutions. Inhibitor concentrates must remain stable over prolonged periods of time so that they may be safely stored until being combined with other components to form a metal pickling or cleaning solution. That is, the concentrate should remain a homogeneous solution (e.g., no phase separation or precipitation of solids) and should not deteriorate or degrade in effectiveness to a significant extent. Moreover, the solutions prepared from such concentrates must meet stringent customer requirements with respect to cost and performance (e.g., inhibition of metal etching), both immediately and over time (e.g., as iron levels in the solution increase upon continued use of the solution).

Many types of metal loss inhibitor compositions are known in the art, with several being available commercially. However, in many cases such formulations exhibit poor solubility at the high working pHs and high ionic concentrations typical of the best chelating cleaning solutions, exhibit poor rinsing, interfere with copper removal or suffer from manufacturing limitations, e.g. environmentally undesirable, hazardous or scarce raw materials. Further improvements in the art of metal loss inhibitor concentrates and metal cleaning and pickling solutions would therefore be desirable.

BRIEF SUMMARY OF THE INVENTION

It has been found that particularly effective metal loss inhibition of chelating cleaning solutions can be achieved by use of an inhibitor that comprises, preferably consists essentially of, or more preferably consists of water and the following components:

(A) an amount of a component of dissolved organic compounds and polymers that contain at least two hydroxy moieties per molecule and an average of at least 0.4 hydroxy moieties per carbon atom;

(B) an amount of a thiourea component; and (C) an amount of a dissolved component containing aryl and quaternary ammonium moieties; and, optionally, one or more of the following components:

(D) an amount of a wetting agent, such as a component of an ethoxylate of an alcohol having Formula $R_1$—OH wherein $R_1$ is a saturated or unsaturated, straight-chain or branched aliphatic having from 12 to 80 carbon atoms.

It should be understood that other optional components, as are known in the art, such as a dye and/or a defoamer, etc. can also be used.

In another embodiment, the inhibitor comprises, preferably consists essentially of, or more preferably consists of water and the following components:

(B) an amount of a thiourea component; and (C) an amount of a component of dissolved aryl moiety containing quaternary ammonium salts; and, optionally, one or more of the following components:

(D) an amount of a wetting agent, such as a component of an ethoxylate of an alcohol having Formula $R_1$—OH wherein $R_1$ is a saturated or unsaturated, straight-chain or branched aliphatic having from 12 to 80 carbon atoms.

In the above embodiment, the inhibitor can be added to a cleaner solution that may or may not have solvent therein.

In at least certain embodiments, the present invention provides metal loss inhibitor concentrates comprising water; at least one water-soluble and/or water-dispersible organic solvent; at least one thiourea, desirably an N-substituted thiourea, more desirably a di-substituted thiourea wherein the substituent groups are alkyl groups, for example diethylthiourea, diisopropylthiourea, dibutylthiourea and the like; a quaternary organic ammonium compound; and optionally a surfactant, desirably an nonionic surfactant, more desirably a polyether ether alcohol surfactant.

The concentrates of the present invention form useful metal cleaning and pickling solutions when combined with a chelating cleaning solution. These solutions, when contacted with a metal surface such as a ferriferous, or nickel and/or copper containing alloy surfaces, are effective in removing scale and other deposits from the metal surface while exhibiting a markedly reduced tendency to attack or etch the metal itself. The metal cleaning and pickling solutions of the present invention exhibit particularly good protection against base metal etching. Desirably the concentrate composition has a freezing point of less than 32, 20, 10, or 0 degree F.

Another aspect of the invention is a method of cleaning or pickling a substrate having a metal surface, the method comprising contacting the metal surface with a chelating cleaning solution according to the invention described herein.

In one embodiment, the invention provides a method of cleaning or pickling a substrate having a metal surface, the method comprising: a) forming a solution by combining water, an organic acid and/or an organic acid salt, at least one water-soluble and/or water-dispersible organic solvent; at least one thiourea; a quaternary organic ammonium compound; and optionally a surfactant; and b) contacting the metal surface with the solution.

In one embodiment, the solution is formed by combining a concentrate comprised of water, at least one water soluble and/or water dispersible organic solvent, at least one thiourea; a quaternary organic ammonium compound; and optionally a surfactant with an aqueous solution of an organic acid and/or an organic acid salt.

Except in the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counter-ions to produce electrical neutrality for the composition as a whole (any counter-ions thus implicitly specified should preferably be selected from among other constituents explicitly specified in ionic form, to the extent possible; otherwise such counter-ions may be freely selected, except for avoiding counter-ions that act adversely to the objects of the invention); the first definition of an acronym or other abbreviation applies to all subsequent uses herein of the same abbreviation and applies mutatis mutandis to normal grammatical variations of the initially defined abbreviation; the term "mole" and its variations may be applied to elemental, ionic, and any other chemical species defined by number and type of atoms present, as well as to compounds with well defined molecules.

DETAILED DESCRIPTION

The water-soluble and/or water-dispersible organic solvent (i.e., component A) can be any such solvent that provides a homogenous and stable concentrate composition and does not otherwise interfere with the metal loss inhibiting action of the other components of the composition. Features of stability of a concentrate include freeze/thaw stability, heat stability and shelf life. Freeze/thaw stability is exhibited by compositions which after a freeze/thaw cycle can be remixed to a homogeneous composition that does not separate upon standing at room temperature. Heat stability of compositions is exhibited where no visible change in appearance, viscosity or precipitation upon exposure to temperatures of 100, 110, or 120 degree F. for at least, in increasing order of preference, 2, 3, 4, or 5 days. Suitable shelf life, wherein the concentrate does not separate such that it cannot be readily remixed into a homogeneous mixture or show diminished performance of more than 5, 2.5 or 1.25%, is desirably at least 3, 6, 12, 18 or 24 months.

While any suitable water-soluble and/or water-dispersible organic solvent can be used, examples of certain suitable solvents include for example any water dispersible alcohol, ketone or ether alcohol and the like. In at least one embodiment, preferably the organic solvent is non-flammable, economical and has low vapor pressure, meaning a vapor pressure less than or equal to water and/or meets EPA Test Method 24 as being low or zero VOC.

With increasing preference in the order given, at least 50, 60, 70, 75, 80, 85, 90, 95, or 99% of the mass of molecules selected for component (A) is selected from the group consisting of ethylene glycol, propylene glycol, and polyoxyalkylenes in which at least 50, 60, 70, 75, 80, 85, 90, 95, or 99% of the mass of the polyoxyethylenes consists of ethylene oxide residues. Any remaining part preferably consists of residues of alkylene oxides having no more than, with increasing preference in the order given, 5, 4, or 3 carbon atoms per molecule. Independently of other preferences, the weight average molecular weight of molecules selected for component (A) preferably is at least, with increasing preference in the order given, 65, 100, 150, 200, 250, 300, 350, 400, 450, 500, 550, or 575 daltons and independently preferably is not more than, with increasing preference in the order given, 10,000, 5000, 4000, 3000, 2000, 1500, 1000, 900, 800, 700, 650, or 625 daltons. A major disadvantage for higher molecular weight polymers for component (A) is excessive viscosity of the compositions, while lower molecular weight polymers and the two glycols are at least partially volatile as defined by the EPA. The organic solvent helps to provide desired properties including adding only negligent amounts of volatile organic content to the mixture. This material can also help to prevent precipitate sometimes seen with some other commonly used solvents.

In a metal loss inhibitor concentrate composition according to certain embodiments of the invention, the weight percent of component (A) preferably is at least, with increasing preference in the order given, 25.0, 27.0, 30.0, 32.0, 34.0, 36.0, 38.0, or 39.0% of total composition and independently preferably is not more than, with increasing preference in the order given, 60.0, 55.0, 52.0, 50.0, 48.0, 46.0, 44.0, 42.0, or 41% of the total composition.

The thiourea (i.e., component B) can be any suitable thiourea compound. In at least one embodiment, the thiourea compound is an N-substituted thiourea. In one variation, the thiourea compound is a di-substituted thiourea compound wherein the substituent groups are alkyl groups. Examples of suitable thioureas compound include, for example, diethylthiourea, diisopropylthiourea, dibutylthiourea and the like. In at least one embodiment, the thiourea comprises 1,3-diethylthiourea.

In a metal loss inhibitor concentrate composition according to certain embodiments of the invention, the weight percent of component (B) preferably is at least, with increasing preference in the order given, 1.0, 1.75, 2.0, 2.50, 3.0, 4.5, 5.25, or 6.0% of total composition and independently preferably is not more than, with increasing preference in the order given, 20.0, 17.5, 15.0, 12.5, 10.0, 8.5., 7.5, 7.0, or 6.5% of the total composition.

Also, the amount of component (A) preferably has a ratio to the amount of component (B), measured in the same mass or weight units, that is at least, with increasing preference in the order given, 0.5:1.0, 1.0:1.0, 1.5:1.0, 2.0:1.0, 3.0.0:1.0, 3.5:1.0, 4.0:1.0, or 6.0:1.0 and independently preferably is not more than, with increasing preference in the order given, 20.0:1.0, 17.5:1.0, 15.0:1.0, 12.5:1.0, 10.0:1.0, 7.5:1.0, or 7.0:1.0.

The dissolved component containing aryl and quaternary ammonium moieties (i.e. component (C)) can be any suitable compound containing aryl and quaternary ammonium moieties. In at least one embodiment, the component containing aryl and quaternary ammonium moieties comprises an aryl quaternary ammonium compound, such as an aryl quinolinium halide. In at least certain embodiments, the aryl quinolinium halide comprises 1-benzylquinolinium halide. Suitable examples include 1-benzylquinolinium chloride, 1-benzylquinolinium bromide, and the like. In at least one embodiment, halogen free compounds can also be used. In at least one embodiment, the material for component (C) can be economically supplied in a solution of water and an aryl quaternary ammonium salt.

In a metal loss inhibitor concentrate composition according to certain embodiments of the invention, the weight percent of component (C) preferably is at least, with increasing preference in the order given, 1.0, 1.75, 2.5, 3.0, 4.0, 5.0, or 5.5% of total composition and independently preferably is not more than, with increasing preference in the order given, 20.0, 15.0, 12.5, 10.0, 7.5, 6.0, or 5.7% of the total composition.

Also, the amount of component (A) preferably has a ratio to the amount of component (C), measured in the same mass or weight units, that is at least, with increasing preference in the order given, 1.0:1.0, 3.0:1.0, 4.5:1.0, or 7.0:1.0, and independently preferably is not more than, with increasing preference in the order given, 15.0:1.0, 12.0:1.0, 9.0:1.0, or 7.2:1.0.

In one embodiment of the invention, the metal loss inhibitor concentrate includes one or more wetting agents (i.e., Component D), which generally help to improve the performance of the cleaning and pickling solutions prepared from the concentrate. Such wetting agents typically are surfactants, including in particular non-ionic and cationic surfactants. The wetting agent can, if desired, be selected so as to impart foaming properties to the metal cleaning and pickling solutions prepared from the metal loss inhibitor concentrates of the present invention. In one embodiment of the invention, however, one or more wetting agents are selected such that the resulting solution is essentially non-foaming (i.e., exhibits substantially no propensity to form foam when the solution is being used to treat metal substrates).

Ethoxylated fatty alcohols represent a class of especially preferred wetting agents, as at least some members of this class appear to impart synergistic performance improvements to the metal loss inhibitor concentrates and solutions prepared therefrom. In particular, it has been unexpectedly discovered that pickling or cleaning solutions containing at least certain ethoxylated fatty alcohols are particularly effective in inhibiting ferriferous base metal loss (i.e., lowering the etch rate), especially in crevices, when the solutions contain tetraammonium EDTA under steam pressure and at temperatures of 150 degree C. On the other hand, certain cleaning solvents that contained sodium salts of EDTA and tested at lower temperatures, such as between 66 and 93 degree C., performed best without added surfactant.

Illustrative ethoxylated fatty alcohols include alcohols substituted with one or more $C_6$-$C_{22}$ linear as well as branched aliphatic groups (including alkyl groups as well as alkylene groups containing one or more carbon-carbon double bonds per alkylene group) that have been reacted (ethoxylated) with from about 2 to about 50 moles of ethylene oxide per mole of alcohol as well. The ethoxylated fatty alcohol may be based on a glycol (e.g., a compound containing two OH groups per molecule). Specific examples of useful ethoxylated fatty alcohols include ethoxylated coco alcohols, ethoxylated dodecylalcohols, ethoxylated octadecylalcohols, ethoxylated soya alcohols, ethoxylated oleyl alcohols, ethoxylated stearic alcohols. In at least one embodiment, ethoxylated $C_8$-$C_{22}$ alcohols containing an average of from about 8 to about 30 (e.g., from about 10 to about 25) moles of reacted ethylene oxide per mole of alcohol are preferred. Other types of wetting agents that can be utilized include, for example, ethoxylated nonylphenols, ethoxylated amines, ethoxylated fatty acids, fluorosurfactants and the like.

Suitable ethoxylated fatty alcohols can have the formula:

$$R—(CH_2CH_2O)_m—H$$

wherein R is a straight-chain or branched, saturated or unsaturated aliphatic group having from 6 to 22 carbon atoms, m is at least 1 and up to about 50. Mixtures of such compounds may also be utilized.

In at least one embodiment, the wetting agent (D) comprises an ethoxylate of an alcohol having Formula I: $R_1$—OH wherein $R_1$ is a saturated or unsaturated, straight-chain or branched aliphatic having from 12 to 80 carbon atoms. The ethoxylate of an alcohol having Formula I is a 5 mole to 80 mole ethoxylate. In at least one embodiment, the ethoxylate of an alcohol having Formula I is a 5 to 30 mole ethoxylate. In at least another embodiment, the ethoxylate of an alcohol having Formula I is a 10 to 25 mole ethoxylate. In at least yet another embodiment, the ethoxylate of an alcohol having Formula I is a 20 mole ethoxylate. In another variation of the invention component D is a 5 to 80 mole ethoxylate and $R_1$ is a saturated or unsaturated, straight-chain or branched alkyl having from 20 to 70 carbon atoms. Moreover the following combinations which characterize component D have also been found useful: component D is a 15 mole ethoxylate and $R_1$ is a saturated or unsaturated, straight-chain or branched alkyl having 13 carbon atoms; component D is a 12 mole ethoxylate and $R_1$ is a saturated or unsaturated, straight-chain or branched alkyl having 14 carbon atoms; component D is a 10 mole ethoxylate and $R_1$ is a saturated or unsaturated, straight-chain or branched alkyl having 16 carbon atoms; and component D is a 10 mole ethoxylate and $R_1$ is a saturated or unsaturated, straight-chain or branched alkyl having 18 carbon atoms. The ethoxylate of an alcohol having Formula I is optionally capped with propylene oxide, chlorine, alkyl, and the like. In at least one embodiment, a particularly preferred ethoxylate is a 20 mole ethoxylate of oleyl alcohol. Oleyl alcohol is a primary alcohol with the formula $CH_3(CH_2)_7$—CH═CH$(CH_2)_8$OH.

In a metal loss inhibitor concentrate composition according to certain embodiments of the invention, the weight percent of component (D) preferably is at least, with increasing preference in the order given, 0.5, 0.75, 1.0, 1.25, 1.5, 1.75, 2.0, or 2.25% of total composition and independently preferably is not more than, with increasing preference in the order given, 10.0, 7.5, 6.0, 5.0, 4.0, 3.5, 3.0, or 2.75% of the total composition.

Also, the amount of component (A) preferably has a ratio to the amount of component (D), measured in the same mass or weight units, that is at least, with increasing preference in the order given, 1.0:1.0, 3.0:1.0, 5.0:1.0, 7.5:1.0, 10.0:1.0, 12.0:1.0, 13.0:1.0, or 15.0:1.0 and independently preferably is not more than, with increasing preference in the order given, 30.0:1.0, 27.5:1.0, 25.0:1.0, 22.5:1.0, 20.0:1.0, 17.5:1.0, or 17.0:1.0.

As those skilled in the art will appreciate, however, the concentration and amounts of components described herein may be varied as needed or desired depending, among other factors, the extent to which the concentrate will be diluted to form a metal cleaning or pickling solution as well as the desired concentration of components in the metal cleaning or pickling solution.

The components of the metal loss inhibitor concentrates can be combined in any suitable manner to form the metal loss inhibitor concentrates of the present invention.

The concentration of chelating acid salts or ammonia itself in the metal cleaning or pickling solution may be adjusted as needed in order to achieve the desired level of cleaning activity. As the amount of dissolved metal increases, the "free, uncomplexed" concentration of chelating acid salts may fall below a desired minimum for effective cleaning and to maintain solution stability. Losses of ammonia though evaporation has similar effects and can also be replaced to return the pH to proper levels. Typically, the components selected and the concentration of components in the metal cleaning or pickling solution are effective to provide a solution having a pH of from 3 up to 10, and desirably in the range of 4-9.5.

The metal loss inhibitor concentrates described herein can be utilized to particularly good advantage in applications involving pickling of ferrous surfaces to give a non-pitted, shiny appearance with no visible metal loss and a surface that is resistant to flash rusting.

In general, the metal loss inhibitor concentrates of the present invention are incorporated into chelating cleaning solutions in any amount effective to reduce the tendency of the cleaner to attack and corrode without significantly interfering with the cleaning operation performed by the aqueous chelating solution. The optimum amount of metal loss inhibitor concentrate to be combined with an aqueous chelating solution will vary depending on a number of factors, including the particular active components present in the concentrate (e.g., the particular thiourea, the particular organic quaternary ammonium compound, the particular wetting agent, if present, etc.), the make-up of the chelating cleaner, the type of metal being cleaned, as well as the cleaning conditions (e.g., contact time, pH, temperature).

Typically, however, one part by volume of the metal loss inhibitor concentrates of the present invention is diluted with increasing preference in the order given, 100, 250, 500, 700, 850 or 950 parts by volume of aqueous chelating cleaner, and independently preferably is not more than, with increasing preference in the order given, 10,000, 8,000, 6,000, 5,00, 3,000, 1,500, 1,250 or 1,050 parts by volume of aqueous chelating cleaner. That is, the metal loss inhibitor concentrate typically is combined with an aqueous chelating cleaner solution at a concentration of from about 0.01 to about 2 (e.g., about 0.05 to about 0.5) % on a volume/volume basis. The actual amount of inhibitor desired is often determined experimentally using actual boiler tubes and their deposits removed from the unit to be cleaned in lab simulation. The concentrate may first be combined with a relatively concentrated chelating cleaner solution, and the present invention allows such a mixture to be stable due to its high solubility in high pH and ionic strength solutions compared to currently used products based on amines. The resulting mixture can then be conveniently diluted with water on site to yield the working solution that will be used to clean and/or pickle a metal surface. Such a mixture may also conveniently be used to replenish an existing pickling solution where the concentrations of chelating cleaner and/or metal loss inhibiting substances have fallen below the desired levels. Alternatively, the concentrate may be combined directly with an aqueous solution having the chelating cleaner concentration desired for purposes of the cleaning and pickling solution.

In certain embodiments, the metal cleaning or pickling solution may contain concentrations of components within the following ranges:

| Component | Certain Embodiments (Wt. %) | Certain Other Embodiments (Wt. %) | Certain Yet Other Embodiments (Wt. %) |
|---|---|---|---|
| A | 0.001% to 1.0% | 0.01% to 0.50 % | 0.04% |
| B | 0.00001% to 1 | 0.0001% to 0.1% | 0.0063% |
| C | 0.00001% to 1% | 0.0001% to 0.1% | 0.0056% |
| D | 0.0001% to 0.2% | 0.001% to 0.05% | 0.0025% |
| Acid Salt | 0.01% to 50% | 1.0% to 30% | 4.5% |
| Water | Remainder | Remainder | Remainder |

The above-stated concentration ranges are based on the amounts of the individual components as initially charged to the solution.

It should be understood that other optional components, as are known in the art, such as dyes, defoamers, sodium and other salt solutions, foaming agents, ammonium bifluoride and oxidizers can also be used.

Generally speaking, cleaning and pickling solutions containing the metal loss inhibitor concentrates of the present invention can be utilized to treat any of a variety of metals. Examples of metal surfaces include both pure metals and alloys such as, for example, aluminum (including aluminum alloys), magnesium, zinc, titanium, iron, copper, steel (including, for example, cold rolled steel, hot rolled steel, galvanized steel, alloy steel, carbon steel), bronze, stainless steel, brass and the like. For example, the substrate to be contacted with the solution may be comprised of at least 50 percent by weight of aluminum, zinc or iron. The substrate comprising the metal surface to be treated in accordance with the present invention can take any form, including, for example, wire, wire mesh, sheets, strips, panels, shields, vehicle components, casings, covers, furniture components, aircraft components, appliance components, profiles, moldings, pipes, frames, tool components, bolts, nuts, screws, springs or the like. The metal substrate can contain a single type of metal or different types of metal joined or fastened together in some manner. The substrate to be treated in accordance with the process of the present invention may contain metallic portions in combination with portions that are nonmetallic, such as plastic, resin, glass or ceramic portions.

The metal cleaning or pickling solutions prepared from the metal loss inhibitor concentrates of the present invention exhibit good consistent inhibition of metal etching even when the solution is operated at relatively high temperatures over an extended period of time and/or contains a high iron loading level. For example, the solution may be maintained at temperatures of from ambient (i.e., about 68 degrees F.) to about 300 degrees F. The metal surface with scale or other material deposited or adhered thereon which is to be cleaned and/or pickled is contacted with the solution for a time and at a temperature effective to remove the desired amount of scale or other material from the metal surface, leaving a cleaned and/or descaled and/or pickled surface with reduced loss (etching) of the metal itself as compared to contacting with the same type of solution which does not contain a metal loss inhibitor concentrate in accordance with the present invention. The solution may be brought into contact with the metal surface using any suitable or known method such as, for example, fill and drain with or without mixing or sparging, flow through, foaming, dipping (immersion), brushing, spraying, roll coating, wiping, and the like. Once the solution has been in contact with the metal surface for the desired period of time, the substrate having the metal surface may be removed from contact with the bulk of the solution (for example, by extracting the substrate from a tank or vat containing the solution). Residual solution clinging to the metal surface may be allowed to drain off the surface or removed by other means such as wiping. The metal surface may be rinsed with water or another solution to remove any remaining solution and/or to neutralize any residual acid salts and/or to prevent "flash rusting" of the freshly exposed metal surface.

The invention is particularly advantageously applicable to use with cleaning solutions that, in addition to the inhibitor and water, comprise, or preferably consist essentially of, salts of ethylene diamine tetraacetic acid (hereinafter usually abbreviated as "EDTA") with ammonia, hydrazine, or amines in amounts from 0.5 to 20% of the total working cleaning solution. In addition to EDTA, other acids such as citric acid, acetic acid, hydroxyacetic (glycolic acid), formic acids, phosphonic acids and the like may be suitable acids for use. More preferably, the percentage of such salts in a working cleaning composition according to this invention is at least, with increasing preference in the order given (as EDTA), 1.0, 1.5, 2.0, 2.5, 3.0, 3.5, or 4.0% and independently preferably is not more than, with increasing preference in the order given, 15,10, 8.0, 7.5, 7.0, 6.5, 6.0, 5.0, or 4.5%. Other common constituents of working compositions that do not change the basic and fundamental nature of the inventions described herein include fluoride ions, which often accelerate the dissolution of magnetite and silica containing scale.

Metallic copper and copper containing scale is often found even on surfaces to be cleaned that do not contain any significant amount of copper, because the water circulating through a boiler or similar equipment often dissolves copper from other parts of the equipment that it contacts during such circulation. When such water contacts a more electrochemically active ferriferous surface, at least some of the copper content can be deposited on the ferriferous surface by "displacement plating", i.e., the dissolution of an amount of iron as cations to balance the electric charge of the copper cations converted at the surface to elemental form. Once it has been deposited, the elemental copper can itself react to form oxides and other types of scale which can redissolve and plate out again. If copper is present, oxidizing agents can be added to facilitate and/or accelerate the removal of copper containing scale in a subsequent metallic copper removal step. Any suitable oxidating agent can be used. For example, air and/or oxygen gas could be injected (e.g., sparged) into the solution. Another example could be introducing sodium nitrite solution into the solution. The amount and length of time of the use of oxidant can vary as needed, but typically oxidizing agents are added until most or all of the copper is removed.

A process according to the invention comprises, at a minimum, contacting a metal workpiece to be cleaned with a working cleaning solution according to the invention as described above. The operating conditions are generally preferably the same as with otherwise similar cleaning compositions inhibited with prior art inhibitors. For cleaning boiler tubes or other workpieces that are designed to operate under pressure, preferred conditions include a temperature above the boiling point of water, to speed the dissolution process. For example, for removing deposits in which the major metallic constituent is iron using tetraammoniated EDTA, the temperature preferably is, with increasing preference in the order given, at least 103, 108, 113, 118, 123, 128, or 133 degree C. and independently preferably is, with increasing preference in the order given, not more than 149, 145, 141, or 138 degree C. However when using di or triammoniated EDTA or other chelating salts, compositions according to the invention may also be used at a lower temperature, particularly one below the boiling point of the composition, and such use may be more economical, even though longer contact times will usually be required, and for cleaning objects not themselves suited to contain pressures in excess of atmospheric pressure. The gas in equilibrium with the liquid cleaning composition preferably is supplied only by vaporization of the sufficiently volatile constituents of the cleaning solution, without the addition of any other gas.

The time during which the workpiece is in contact with a cleaning composition according to this invention during a process according to this invention preferably is sufficient to remove scale and other bulk oxide coatings from the workpiece surface, a time which naturally varies considerably under the influence of such factors as the exact composition of the scale to be removed, the thickness of the scale and of any other soil to be removed, the temperature(s) maintained during contact, and the specific chemical nature(s) of the scale and/or other soil to be removed. Under many common operating conditions, the time of contact at preferred temperature preferably is at least, with increasing preference in the order given, 1.0, 2.0, 3.0, 3.5, 4.0, 4.5, 5.0, or 5.5 hours and independently preferably is not more than 24, 16, 13, 10, 8.0, 7.5, 7.0, 6.5, or 6.0 hours. Contact between the workpiece and the working cleaning composition is generally by immersion, or, if the surface to be cleaned defines a hollow space that can function as a liquid container, by filling this container with the cleaning composition to at least a sufficiently high level to contact all of the scale and/or other soil desired to be removed. Any process of establishing the requisite contact, such as those known per se in the art, may be used such as continuous sampling and analysis of the metal content of the solution and near constant values indicating completion.

The practice and benefits of the invention may be further appreciated by consideration of the following non-limiting examples. The effectiveness of the pickling or cleaning solutions of the present invention in reducing the amount of base metal loss when the solutions are used to treat metal surfaces is demonstrated in the following examples.

EXAMPLES

The examples below simulate the typical (iron removal first step and in some cases the metallic copper removal second step) cleaning of a large utility boiler using tetra-ammoniated ethylenediaminetetraacetic acid or $(NH_4)_4EDTA$ 4% wt/vol (as EDTA)

Step 1

A bolted closure one-gallon stirred (magnetically coupled shaft) autoclave equipped with a polytetrafluoroethylene panel holder designed to hold up to four 2×4" panels attached to the stirring shaft to simulate liquid flow, a heating and cooling system, temperature (both internal vessel and furnace probes recorded) and pressure sensors and data recorders are utilized. 2 liters of test cleaning solution are held in a borosilicate glass liner (weighed dry before run and then with and without liquid after run[1]) to separate the liquid from the 316 SS construction of the reactor vessel during testing is employed. The solution at room temperature is prepared, panels wiped 2 times with IPA, dried and weighed to 0.1 mg, assembled and then the stirrer is started and its speed adjusted to 20 RPM.

[1] At the end of every run there was noted (a settled volume of about 5% that of the bulk liquid) white $SiO_2$ floc which appears to represent the loss of liner. The liner is replaced periodically after several runs as the thickness diminishes. This demonstrates that the removal of silica containing deposits is likely even without fluoride additives. Dissolved deposits are likely to reprecipitate from solution at lower temperatures in the absence of additives. However, this precipitate is very low in density and easily suspends and becomes mobile in a flow of liquid. The last traces of this resulting form of silica should easily rinse away during routine clean water flushes. None of the tested inhibitors appear to interfere with the assumed to be desired property of corrosiveness to silicate containing glass or its reprecipitation.

The temperature is raised with the use of a computerized ramping program to preserve repeatability and cooled by removing the furnace unit and employing a mounted fan set to high. Time to heat from approximately 70 degree F. to 300 degree F. operating temperature is 2.0 hours, while the time to cool to less than 100 degree F. is 3.0 hours.

Although the stated loss values are related to 24 hours at a temperature at 300 degree F. in the following examples, actual time held at 300 degree F. during a standard run is 23.0 hours, with the missing 1.0 hour estimated to occur during the warm-up and cool-down times. This is due to the difficulty in removing the specimens from the bolted-closed vessel if the temperature is not close to ambient. In addition, gas pressure can be easily measured at close-to ambient temperatures. Thus, if present, the gas itself is captured and volume measured before opening after cool-down.

Inadequate inhibition always results in measurable amounts of flammable gas (tested via butane lighter method). All adequately inhibiting systems tested show no easily (greater than approximately 2 ml/2 L) measurable amounts of gas. A data recorder documents the run, indicating any time to failure and preserves run integrity. The stirred pressure vessel and panel holder system (rated 1-gallon without liner or panel holder) was custom manufactured by Autoclave Engineers (a division of Snap-Tite Inc) of Erie, Pa. Serial number 96104234-1. The data acquisition system was a Personal Daq 56 USB acquisition module sold by IOtech Inc of Cleveland Ohio connected and controlled by their supplied software on an IBM® T23 ThinkPad® computer. Liquid/furnace[2] temperature, pressure and RPM were recorded throughout the run. At the end of a run the chart was printed and attached to a laboratory notebook.

[2] Recording furnace temperatures is valuable since its reading, and thus its power output, is sensitive to, and thus indicative of any leaks in the system and when they were present. The weight of the final liquid also indicates the presence of any leak during a run, but doesn't determine the duration.

Panels tested for inhibition in the high temperature iron removal stage were obtained from METASPEC LCC San Antonio Tex. part number 202-1020-8 ANSI-1020 2×4×1/16" as rolled cold rolled steel. Two panels per run were evaluated on opposite ends of the panel holder. The panels were each wiped twice with fresh wiper surface (folded-over Kimwipes® 119 Kimberly-Clark Roswell Ga.) each time after approximately 1 ml of isopropyl alcohol was applied. The panels were then wiped dry and weighed to 0.0001 g. After exposure the panels were rinsed for 30 seconds in cold running water and the isopropyl wiping repeated before visual evaluation and reweighing to determine weight loss.

In all experimental runs of 4% as EDTA in water and ammonia to pH 9.2-9.4 and temperature of 300 degree F. for a reported time of 24 hours the borosilicate glass liner lost an average of 1.2 g (wetted inside dimensions 9.0"H×4.74"D open top, flat bottom). Before placing the liner into the bolted closure, a volume of deionized water was placed into the vessel under the liner (typical required volume 165 ml) to increase heat transfer from the autoclave walls to the liner and into the cleaning solution. This also helps avoid partial concentration of the cleaning solution during the run which results from vapor condensing to liquid and filling this void during the test.

Step 2

Simulation of metallic copper oxidation and dissolution into the used cleaning solution containing scale dissolved from step 1. (Note, in practice, if lower levels of ammonia (less than pH~9.2) are used for the first step, or some is lost through evaporation, additional ammonia is added after the solution is cooled and before the oxidizer is added. High ammonia levels are required to complex copper.):

To a glass beaker equipped with a water cooled watch-glass type condenser cover, heating mantle and temperature control, add 2 liters fresh cleaning solution consisting of $(NH_4)_4$EDTA 4% wt/vol as EDTA, pH~9.3, mixing throughout testing with magnetic stir bar, add 2.00 ml (0.10 vol/vol %) inhibitor, hang an IPA wiped and weighed 2×4×1/16" 1020 alloy CRS and a 2×4×1/16" 110 copper coupon on separate plastic hooks at opposite ends of the beakers. Add 57.1 g Aldrich 99+% $FeSO_4 \cdot 7H_2O$, which is enough to complex with 75% of the EDTA leaving 1% free (as EDTA) as is typical in an industrial cleaning. The solutions are then heated to 150 degree F. and when the temperature is reached, a small sample is taken, air flow though a bubbler at the bottom of the tank is started at 100 ml/min and a timer started. Additional samples are taken at 1.0 and 3.0 hrs at which time 10.0 g (0.5%) sodium nitrite (auxiliary oxidant) is added. Air injection and 150 degree F. are continued and after an additional hour a final sample is taken. The solutions are then analyzed by ICP for copper content.

Comparative Example 1

A 4% w/v as EDTA tetra ammoniated pH~9.3, control (no inhibitor added). The test panels exhibited the following amount of base metal loss: Average loss for two 2×4×1/16" 1020 alloy CRS coupons=6.5105 g=0.130 lb/ft$^2$/day. The amount of gas generated was not measured.

Example 1

(This inhibitor is found to be useful for a 10% solution of a commercial dry chelate salt cleaner consisting of tetrasodium EDTA (pH~4.5), citric acid, sodium gluconate and Phosphonic acid, (1-hydroxyethylidene)bis-, tetrasodium salt CAS 3794-83-0).

To the 2 liters cleaning solution described in Comparative Example 1, added 0.25 g of a crude mixture consisting of 37.5% 1-(benzyl) quinolinium chloride 15619-48-4, 5-10% quinolinium chloride 530-64-3, 45% ethylene glycol, 10-13% water and 0.50 g 1,3 diethylthiourea. The cleaning solution remained crystal-clear.

Following the same test protocol described above in Comparative Example 1, test panels exhibited the following amount of base metal loss: Average loss for two 2×4×1/16" 1020 alloy CRS coupons=0.5105 g, 0.5143 g, average=0.5124 g=0.0102 lb/ft$^2$/day. The amount of gas generated=50 ml The solution was crystal-clear before and after testing. The panels after testing were clean and bright with no etch lines seen with many other test inhibitors. There was however, significant metal loss at the ends of the panels where they fit into slotted openings (crevice corrosion).

Working Formula Without Surfactant:

After considerable formulation work to produce a stable concentrate which includes the components of Example 1, the following working concentrate was prepared: 100.0 g polyethylene glycol 600, 47.5 g deionized water, 30.0 g of the crude (i.e., 11.25 g of pure) 1-(benzyl) quinolinium chloride 15619-48-4 described in Example 1, 12.50 g diethylthiourea for 190.0 g total weight.

It was found that the addition of oleyl alcohol ethoxylate dramatically improved performance in tetraammoniated EDTA, but its use significantly increased the viscosity of the above working formula. Levels >5% wt/vol would be too high in viscosity (at cold temperatures above its freezing point) for some commercial applications without protection from low temperatures.

Example 2

To the 2 liters cleaning solution described in Comparative Example 1, add 2.21 g (0.100% vol/vol) of a solution consisting of 95% concentrate +5% oleyl alcohol ethoxylate. The cleaning solution remained crystal-clear.

Following the same test protocol described above in Comparative Example 1, test panels exhibited the following amount of base metal loss: Average loss for two 2×4×1/16" 1020 alloy CRS coupons=0.0822 g, 0.0779 g, average=0.0801 g=0.00159 lb/ft$^2$/day. The amount of gas generated=0 ml Example 3

To the 2 liters cleaning solution described in Comparative Example 1, add 2.21 g (0.100% vol/vol) of a solution consisting of 95% concentrate +2.5% oleyl alcohol ethoxylate+ 2.5% deionized water. The cleaning solution remained crystal-clear.

Following the same test protocol described above in Comparative Example 1, test panels exhibited the following amount of base metal loss: Average loss for two 2×4×1/16" 1020 alloy CRS coupons=0.0710 g, 0.0790 g, average=0.0750 g=0.00149 lb/ft$^2$/day. The amount of gas generated=0 ml.

Copper removal results—Cu (ppm) concentration initial=20, 1 hour air=183, 3.0 hrs air=909, +$NaNO_2$ and additional 1.0 hr exposure=1480.

Example 4

To the 2 liters cleaning solution described in Comparative Example 1, add 2.21 g (0.100% vol/vol) of a solution consisting of 95% working solution +1.5% oleyl acholol ethoxylate +3.5% deionized water. The cleaning solution remained crystal-clear.

Following the same test protocol described above in Comparative Example 1, test panels exhibited the following amount of base metal loss: Average loss for two 2×4×1/16" 1020 alloy CRS coupons=0.1003 g, 0.1038 g, average=0.1021 g=0.00202 lb/ft$^2$/day. The amount of gas generated=0 ml Example 5

To the 2 liters cleaning solution described in Comparative Example 1, add 2.21 g (0.100% vol/vol) of a solution consisting of 2.5 g polyethylene glycol 600, 1.7125 g deionized water, 0.375 g pure 1-(benzyl) quinolinium chloride CAS 15619-48-4, Aldrich Rare Organic #S605956, 0.3125 g 1,3 diethylthiourea and 0.100 g oleyl alcohol ethoxylate. The cleaning solution remained crystal-clear.

Following the same test protocol described above in Comparative Example 1, test panels exhibited the following amount of base metal loss: Average loss for two 2×4×1/16" 1020 alloy CRS coupons=0.0737 g, 0.0746 g, average=0.0742 g=0.00147 lb/ft$^2$/day. The amount of gas generated=0 ml Example 6

To the 2 liters cleaning solution described in Comparative Example 1, add 2.21 g (0.100% vol/vol) of a solution consisting of 2.5 g polyethylene glycol 600, 1.6475 g deionized water, 0.440 g pure 1-(benzyl) quinolinium bromide CAS 26323-01-3, Aldrich Rare Organic #S395285, 0.3125 g 1,3 diethylthiourea and 0.100 g oleyl alcohol ethyoxylate. The cleaning solution remained crystal-clear.

Following the same test protocol described above in Comparative Example 1, test panels exhibited the following amount of base metal loss: Average loss for two 2×4×1/16" 1020 alloy CRS coupons=0.0699 g, 0.0777 g, average=0.0738 g=0.00146 lb/ft$^2$/day. The amount of gas generated=0 ml Comparative Example 2

To the 2 liters cleaning solution described in Comparative Example 1, add 2.06 g (0.100% vol/vol) of the commercially available corrosion inhibitor Cronox 240®. The cleaning solution was light brown and moderately hazy. After test, brown water-insoluble solids floating and deposited on glass, sample holder and panels especially at liquid level was present. IPA dissolved these alkyl pyridine containing deposits.

Following the same test protocol described above in Comparative Example 1, test panels exhibited the following amount of base metal loss: Average loss for two 2×4×1/16" 1020 alloy CRS coupons=0.1446 g, 0.1278 g, average=0.1362 g=0.00270 lb/ft$^2$/day. The amount of gas generated=0 ml.

Copper removal results—Cu (ppm) concentration initial=1, 1 hour air=6, 3.0 hrs air=43, +$NaNO_2$ and additional 1.0 hr exposure=57.

Comparative Example 3

To the 2 liters cleaning solution described in Comparative Example 1, add 2.28 g (0.100% vol/vol) of the commercially available corrosion inhibitor Rodine 31A®. The cleaning solution was light brown and moderately hazy. After test, brown water-insoluble solids floating and deposited on glass, sample holder, and panels especially at liquid level was present. IPA dissolved these alkyl pyridine containing deposits.

Following the same test protocol described above in Comparative Example 1, test panels exhibited the following amount of base metal loss: Average loss for two 2×4×1/16" 1020 alloy CRS coupons=0.2092 g, 0.2163 g, average=0.2128 g=0.00422 lb/ft$^2$/day. The amount of gas generated=0 ml.

Copper removal results—Cu (ppm) concentration initial=2, 1 hour air=8, 3.0 hrs air=66, +$NaNO_2$ and additional 1.0 hr exposure=171.

Comparative Example 4

To the 2 liters cleaning solution described in Comparative Example 1, add 2.06 g (0.100% vol/vol) of the commercially available corrosion inhibitor Rodine 20020. The cleaning solution remained crystal-clear.

Following the same test protocol described above in Comparative Example 1, test panels exhibited the following amount of base metal loss: Average loss for two 2×4×1/16" 1020 alloy CRS coupons=0.1153 g, 0.1347 g, average=0.1250 g=0.00248 lb/ft$^2$/day. The amount of gas generated=0 ml.

Copper removal results—Cu (ppm) concentration initial=1, 1 hour air=1, 3.0 hrs air=4, +$NaNO_2$ and additional 1.0 hr exposure=6.

These results demonstrate that: Cleaning solutions of the invention can peform very well in terms of inhibition and solubility in the cleaner solution compared to certain commercial products. The addition of surfactant dramatically increases performance in this application. Several surfactant levels were evaluated in the working concentrate including 1.0, 1.5, 2.5, 4.0, 5, and 10. A particularly useful composition is formulated with 2.5% since it also gave a very good viscosity profile at cold temperatures and would tolerate a partial loss of surfactant activity that might result from contamination that might be present, such as soils, greases or oils.

The Examples also demonstrate that the component containing aryl and quaternary ammonium moieties (1-benzyl quinolinium quaternary fraction) is the active component that provides goods inhibitive and high solubility features to this invention, and not other components of the proprietary crude commercial quaternary ammonium compound source. It is believed that the anion to this quaternary ammonium compound is a spectator and that the hydroxyl or the corresponding EDTA salts of 1-benzyl quinolinium would perform as well as the chloride or bromide salt, with the added benefit of halogen free formulation. Ion exchange of the crude source or other appropriate means of halogen removal that are known in the art can also be used. Pure quinoline itself was determined not to have the performance desired in combination with 1,3 diethylthiourea based on performance, solubility and prevention of localized attacks (i.e., pitting).

Perhaps the most surprising and valuable new feature of the invention is the reduced tendency to inhibit the oxidation and dissolution of metallic copper. It should be noted that metallic copper removal is highly desired in this step. The popular opinion of experts in the boiler cleaning industry is that air alone is not adequate to efficiently remove all the metallic copper and that auxiliary oxidants are required. This data suggest that air alone may be all that is required when using the inhibitor described in this invention. As is done via iron concentration in the first stage, copper removal in the second stage is monitored by sampling and copper analysis of the cleaning solution. Apparently the cleaning can now be done safer, cheaper and quicker than presently realized as a result of reduced labor, equipment use and time, reduced hazardous (strong oxidants such as nitrite, oxygen, hydrogen peroxide) chemical use and disposal, more dependable and efficient inhibition towards steel (step 1), metallic copper removal (step 2) and removal of cleaning solution components (i.e. final rinse).

In addition, it was found that this formulation's cost compares very well with current commercial chelate inhibitor products. Also, a key advantage over commercially available cleaners is in its solubility in concentrated (38% as EDTA) tetraammonium EDTA or concentrated (40% as EDTA) diammonium EDTA solution as is typically supplied to the cleaning site. Rodine® 2002, Rodine® 31A and Cronox® 240 appear to oil out perhaps 50% of its content in concentrated EDTA solutions, while the invention (as Example 3) only oils out <5%. The material that does oil out is apparently not one of the major inhibitor components (is likely residual unreacted quinoline and not the quaternary ammonium derivative). In fact, when the Example 3 is added to concentrated 38% as EDTA tetraammoniated EDTA in the same ratio as is tested in Example 3, mixed, placed in 100 degree F. for 2 hrs, allowed to stand at room temperature 24 hrs, filtered (without any additional mixing) and aged 10 days, the clear filtrate diluted to 4% as EDTA and tested in the autoclave as in Example 3, inhibition was still very acceptable at 0.00248 lb/ft$^2$/day and zero gas generated.

What is claimed is:

1. A metal loss inhibitor concentrate comprising water, (A) an amount of a component of dissolved organic compounds and polymers that contain at least two hydroxy moieties per molecule and an average of at least 0.4 hydroxy moieties per carbon atom;

(B) an amount of a thiourea component, wherein the mass of component (A) has a ratio to the mass of component (B) that is from 4.0:1 to 20.0:1.0 by weight; and (C) an amount of a dissolved component containing aryl and quaternary ammonium moieties;

and, optionally (D) an amount of a wetting agent, comprising an ethoxylate of an alcohol having a saturated or unsaturated, straight-chain or branched aliphatic having from 12 to 80 carbon atoms, wherein component (A) includes an amount of polyoxyalkylenes having a molecular weight exceeding 250 daltons, the amount of polyoxyalkylenes exceeding 50 wt. % of component (A) and the mass of component (A) has a ratio to the mass of component (C) that is from 4.5:1 to 15:1.

2. The metal loss inhibitor concentrate of claim 1, wherein the mass of the thiourea component (B) is from 1% to 20% by weight of the total mass of the metal loss inhibitor concentrate.

3. The metal loss inhibitor concentrate of claim 2, wherein the thiourea component (B) comprises a di-substituted thiourea compound wherein the substituent groups are alkyl groups.

4. The metal loss inhibitor concentrate of claim 2, wherein the thiourea component (B) comprises 1,3-diethylthiourea.

5. The metal loss inhibitor concentrate of claim 1, wherein the component containing aryl and quaternary moieties (C) comprises an aryl quaternary ammonium compound.

6. The metal loss inhibitor concentrate of claim 5, wherein the aryl quaternary ammonium compound comprises 1-benzylquinolinium halide.

7. The metal loss inhibitor concentrate of claim 1, wherein the mass of component (A) has a ratio to the mass of component (D) that is from 1.0:1.0 to 30.0:1.0.

8. The metal loss inhibitor concentrate of claim 7, wherein the wetting agent (D) comprises a 10 to 25 mole ethoxylate of oleyl alcohol.

9. The metal loss inhibitor concentrate of claim 1, wherein component (C) is halogen-free.

10. The metal loss inhibitor concentrate of claim 1, wherein component (A) is adapted to prevent a precipitate.

11. A metal loss inhibitor concentrate comprising water, (A) an amount of a component of dissolved organic compounds and polymers that contain an average of at least 0.4 hydroxy moieties per carbon atom, and the dissolved organic compounds and polymers include an amount of a compound selected from the group consisting of ethylene glycol, propylene glycol, and polyoxyalkylenes, the compound having a molecular weight exceeding 250 daltons;

(B) an amount of a thiourea component; and (C) an amount of a dissolved component containing at least one aryl quaternary ammonium moiety, wherein the mass of component (A) has a ratio to the mass of component (C) that is from 4.5:1 to 15:1.

12. The metal loss inhibitor concentrate of claim 11, further comprising:

(D) an amount of a wetting agent component comprising an ethoxylate of an aliphatic alcohol.

13. The metal loss inhibitor concentrate of claim 11, the mass of component (A) has a ratio to the mass of component (B) that is from 6.0:1.0 to 10.0:1.0 by weight.

14. A method of cleaning or pickling a substrate having a metal surface, said method comprising:

a) forming a solution by combining an aqueous chelating cleaning solution with the metal loss inhibitor concentrate of claim 11; and b) contacting said metal surface with said solution.

15. The method of claim 12 wherein component (D) is present as a 10 to 25 mole ethoxylate of oleyl alcohol.

16. The method of claim 14, wherein one part by volume of the metal loss inhibitor concentrate is diluted with 100 to 10,000 parts of the aqueous chelating solution.

17. The method of claim 14, wherein the aqueous chelating solution comprises salts of ethylene diamine tetra acetic acid, the thiourea component (B) comprises 1,3-diethylthiourea, and the aryl and quaternary ammonium moieties (C) comprise 1-benzylquinolinium halide.

18. A method of cleaning or pickling a substrate having a metal surface, the method comprising:

a) forming a solution by combining the metal loss inhibitor concentrate of claim 11, water, and an organic acid and/or an organic acid salt; and b) contacting the metal surface with the solution; c) optionally adding additional organic acid and/or organic acid salt to the solution; d) optionally adding ammonia to the solution; and e) introducing oxidizer into the solution to remove copper and/or copper containing deposits.

19. A method of cleaning or pickling a substrate having a metal surface, said method comprising:

a) forming a solution by combining an aqueous chelating cleaning solution with the metal loss inhibitor concentrate of claim 1; and b) contacting said metal surface with said solution.

20. The method of claim 19 wherein optional component (D) is present as a 10 to 25 mole ethoxylate of oleyl alcohol.

21. The method of claim 19, wherein one part by volume of the metal loss inhibitor concentrate is diluted with 100 to 10,000 parts of the aqueous chelating solution.

22. The method of claim 19, wherein the aqueous chelating solution comprises salts of ethylene diamine tetra acetic acid, the thiourea component (B) comprises 1,3-diethylthiourea, and the aryl and quaternary ammonium moieties (C) comprise 1-benzylquinolinium halide.

23. A method of cleaning or pickling a substrate having a metal surface, the method comprising:

a) forming a solution by combining the metal loss inhibitor concentrate of claim 1, water, an organic acid and/or an organic acid salt; and b) contacting the metal surface with the solution; c) optionally adding additional organic acid and/or organic acid salt to the solution; d) optionally adding ammonia to the solution; and e) introducing oxidizer into the solution to remove copper and/or copper containing deposits.

* * * * *